US005865301A

United States Patent [19]

Kawabe et al.

[11] Patent Number: 5,865,301

[45] Date of Patent: Feb. 2, 1999

[54] CONSTRUCTION OF KNOB FOR A SWITCH

[75] Inventors: Teruaki Kawabe; Masahiro Ikeshima, both of Tokyo, Japan

[73] Assignee: Niles Parts Co., Ltd., Japan

[21] Appl. No.: 853,881

[22] Filed: May 9, 1997

[30] Foreign Application Priority Data

May 13, 1996 [JP] Japan ..... 8-141121

[51] Int. Cl.[6] ..... H01H 9/00

[52] U.S. Cl. ..... 200/313; 200/308; 200/310

[58] Field of Search ..... 200/313, 314, 200/310, 309, 308, 311, 312, 341, 520

[56] References Cited

U.S. PATENT DOCUMENTS

| | | | |
|---|---|---|---|
| 4,135,073 | 1/1979 | Kobayashi | 200/313 |
| 4,751,385 | 6/1988 | Van Benthusysen et al. | 200/314 |
| 4,933,523 | 6/1990 | Honda et al. | 200/526 |
| 5,605,225 | 2/1997 | Schaeffer | 200/309 |

*Primary Examiner*—David J. Walczak
*Attorney, Agent, or Firm*—Ronald P. Kananen; Rader, Fishman & Grauer

[57] ABSTRACT

A knob construction is provided for an operating knob which operates a lighted switch. A recess is formed in a surface of the operating knob and a projection is formed in the recess. A name plate substantially configured to the recess is melted to the projection in the recess by ultrasonic welding.

11 Claims, 4 Drawing Sheets

CONSTRUCTION OF KNOB FOR A SWITCH

BACKGROUND OF THE INVENTION

1. Field of the Invention

The present invention relates generally to a construction in which a name plate is mounted to an operating knob for operating a switch and, more particularly, to a knob construction suitable for a lighted switch having a light source within the knob.

2. Description of the Related Art

A conventional knob construction for a lighted switch is disclosed, for example, in Japanese Utility Model Publication No. 63-101423. With this construction, a knob is formed with a recess in its surface surrounding the lighting window, and a name plate of a translucent resin material is fixedly mounted by a double-sided adhesive tape.

However, the conventional construction is disadvantageous in that the adhesion of the tape decreases due to changes in environmental conditions such as temperature and humidity, and the name plate is therefore apt to come off the knob. The adhesion of the tape also varies depending on the level of soiling and surface roughness of the name plate and/or of the knob on which the name plate is bonded. Thus, reliable bonding of the name plate is difficult.

Moreover, the double-sided adhesive tape is first bonded to either the knob or the name plate and then they are subsequently placed together for bonding. This is not efficient in manufacturing the knob assembly.

Also, if the knob includes a lighted switch therein, the light exiting the window passes through the adhesive layer applied to the back side of the name plate. The adhesive layer attracts dust and other foreign matter. The dust and foreign matter deposited on the adhesive layer are detrimental to the uniform lighting and reduce the amount of light that emanates from the name plate.

SUMMARY OF THE INVENTION

It is an object of the present invention to provide a knob construction for a lighted switch that solves the problems associated with the conventional knob construction described above.

It is a further object of the present invention to provide a construction in which a name plate is fixedly mounted to a switch knob without using a double-sided adhesive tape, and the manufacturing efficiency of the knob assembly is improved.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, an improved construction of an operating knob is provided for operating a lighted switch. The construction is characterized by a recess formed in a surface of the operating knob, a projection formed within the recess, and a flat plate-like name plate having a geometry substantially configured to the recess, the name plate being melted to the projection in the recess by ultrasonic welding.

The construction preferably further includes a boss which is formed and projects into the recess. The projection is formed on the top surface of the boss. The name plate is fixed on the boss and therefore is not in contact with the entirety of the bottom of the recess.

The construction preferably has a wall that defines the recess and a loop-like projection formed close to the wall. The name plate is placed on the loop-like projection so that the name plate and loop-like projection are melted together, the name plate being welded to the projection all around the periphery of the name plate.

A plurality of projections may be provided with distances therebetween, the projections being arranged in parallel with and close to the wall defining the recess. This construction needs only a smaller amount of energy to weld the knob and lever together.

The boss is formed a certain distance away from the wall defining the recess so that a groove is defined between the wall and the boss. If the boss is formed to be continuous with the wall, a curved surface would result which gradually rises from the top surface of the boss to the vertical wall of the recess. The groove effectively eliminates a chance that the curved surface may push up the name plate if the groove is not formed between the wall and the boss.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention. In the drawings.

DETAILED DESCRIPTION OF THE INVENTION

A first embodiment of the present invention will now be described with reference to FIGS. 1 to 4 of the accompanying drawings.

Figure 1:
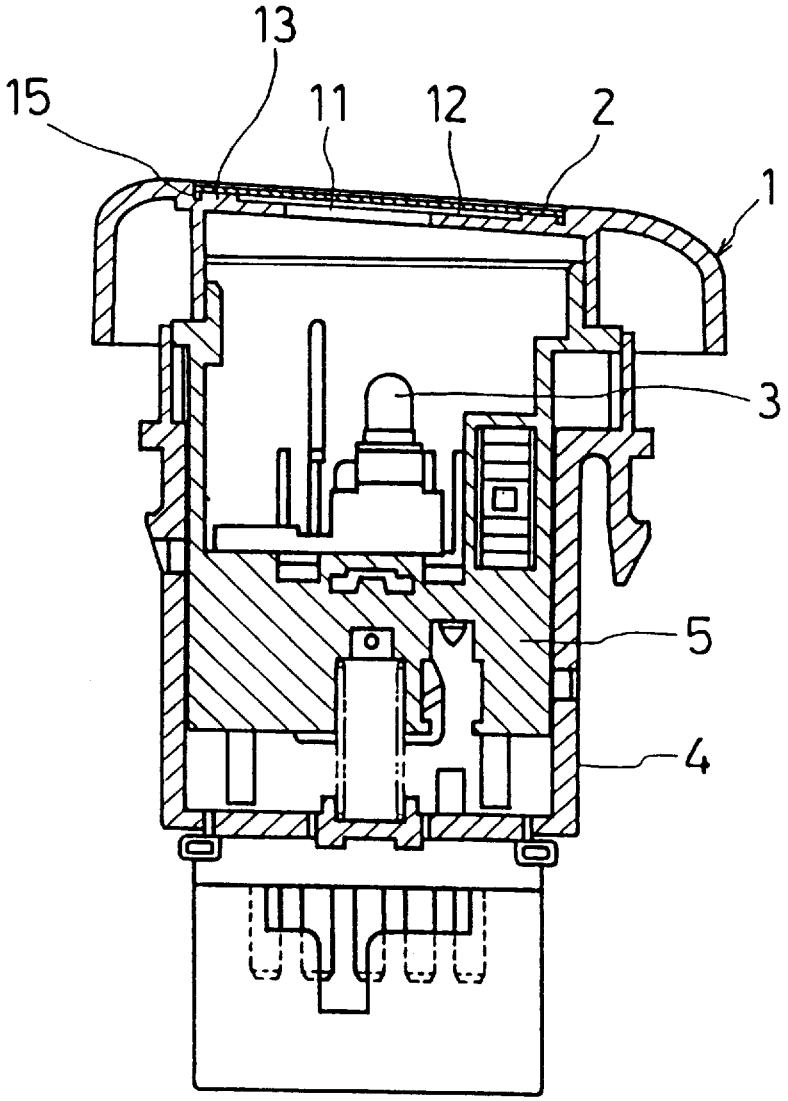
FIG. 1 is a cross-sectional view of a push button switch according to a first embodiment of the present invention.
Figure 2:
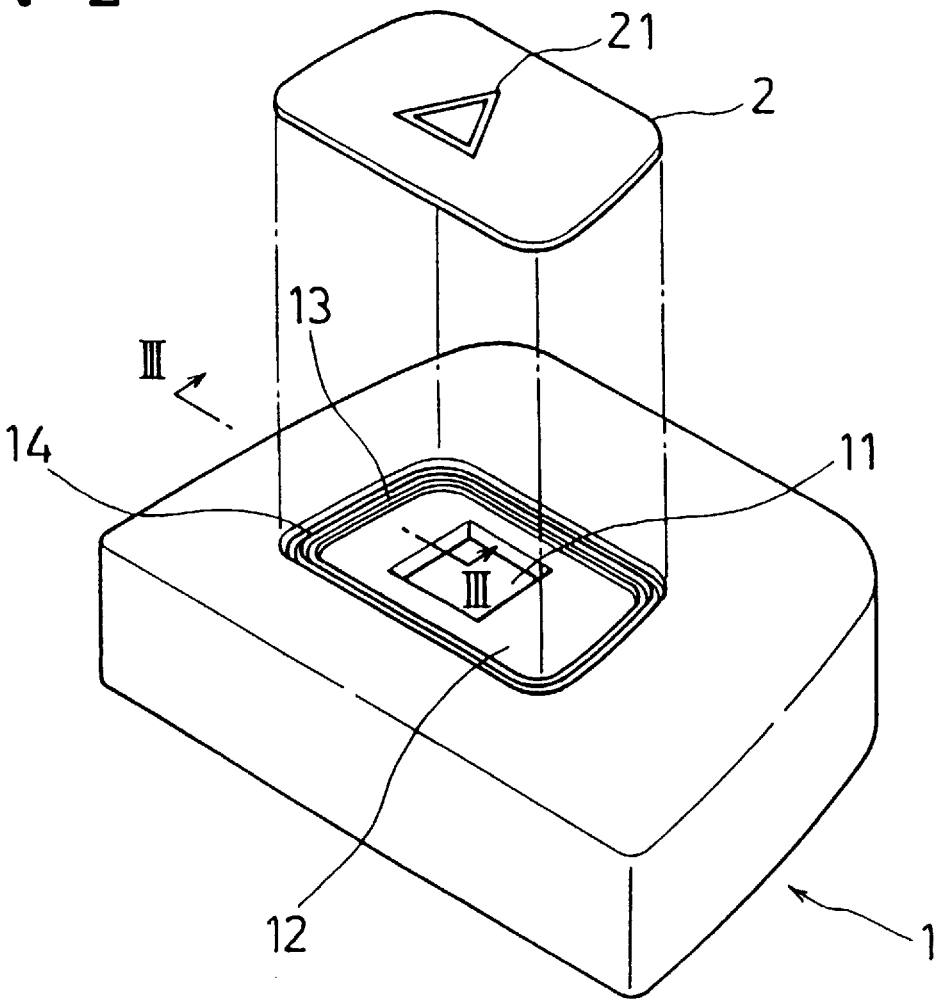
FIG. 2 is a perspective view of a knob and name plate for the push button switch according to the first embodiment of the present invention.
Figure 3:
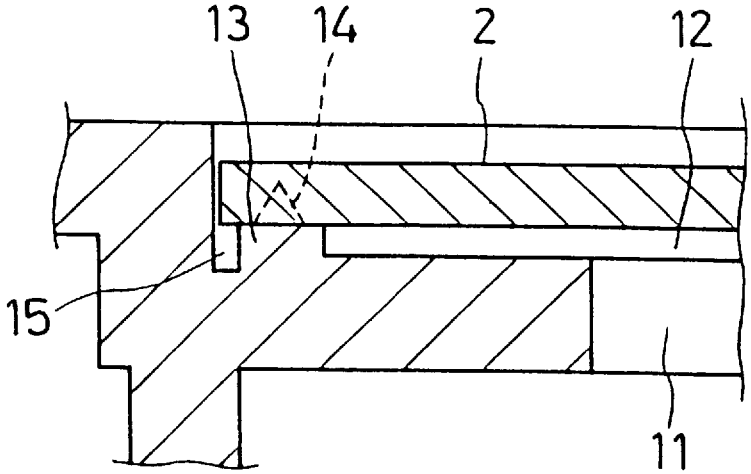
FIG. 3 is a cross-sectional view taken along the lines III—III of FIG. 2, showing a relevant portion of the knob of the first embodiment after the name plate is welded.

FIG. 1 is a cross-sectional view of a push button switch according to a first embodiment of the invention. FIG. 2 is a perspective view of the knob and name plate according to the first embodiment. FIG. 3 is a cross-sectional view taken along the lines III—III of FIG. 2, showing a relevant portion of the knob of the first embodiment after the name plate is welded.

Reference numeral 1 denotes a knob of a switch, and reference numeral 2 denotes a name plate made of a slab of a resin material. A light source 3 is provided for lighting the name plate 2. A substrate 4 having fixed contacts formed thereon holds the light source 3. A movable body 5 having movable contacts thereon slides on the fixed contact formed in the substrate 4.

As shown in FIGS. 2 and 3, the knob 1 is provided with a shallow recess 12 in its operating surface and a window 11 extending through the bottom of the recess 12. Light emitted from the light source 3 passes through the window 11 for lighting the name plate 2. A loop-like boss 13 is formed on the flat bottom of the recess 12 near the wall defining the recess 12. The boss 13 has a rectangular cross section and a loop-like projection 14 formed on its upper surface along the loop-like boss 13. The projection 14 has a triangular cross section. A groove 15 is defined between the boss 13 and the wall that defines the recess 12. The window 11 is just wide enough for lighting purpose but as small as possible so that the unwanted light will not leak from the knob 1.

The name plate 2 is a slab of a resin material substantially configured to the contour of the recess 12 formed in the knob 1. A mark or character 21 is printed on the name plate 2 and indicates the type of the switch. The back side of the name plate 2 is painted black except for the area in which the mark or character 21 is printed, so that light will pass only through the mark or character 21 and no light will leak.

Figure 4:
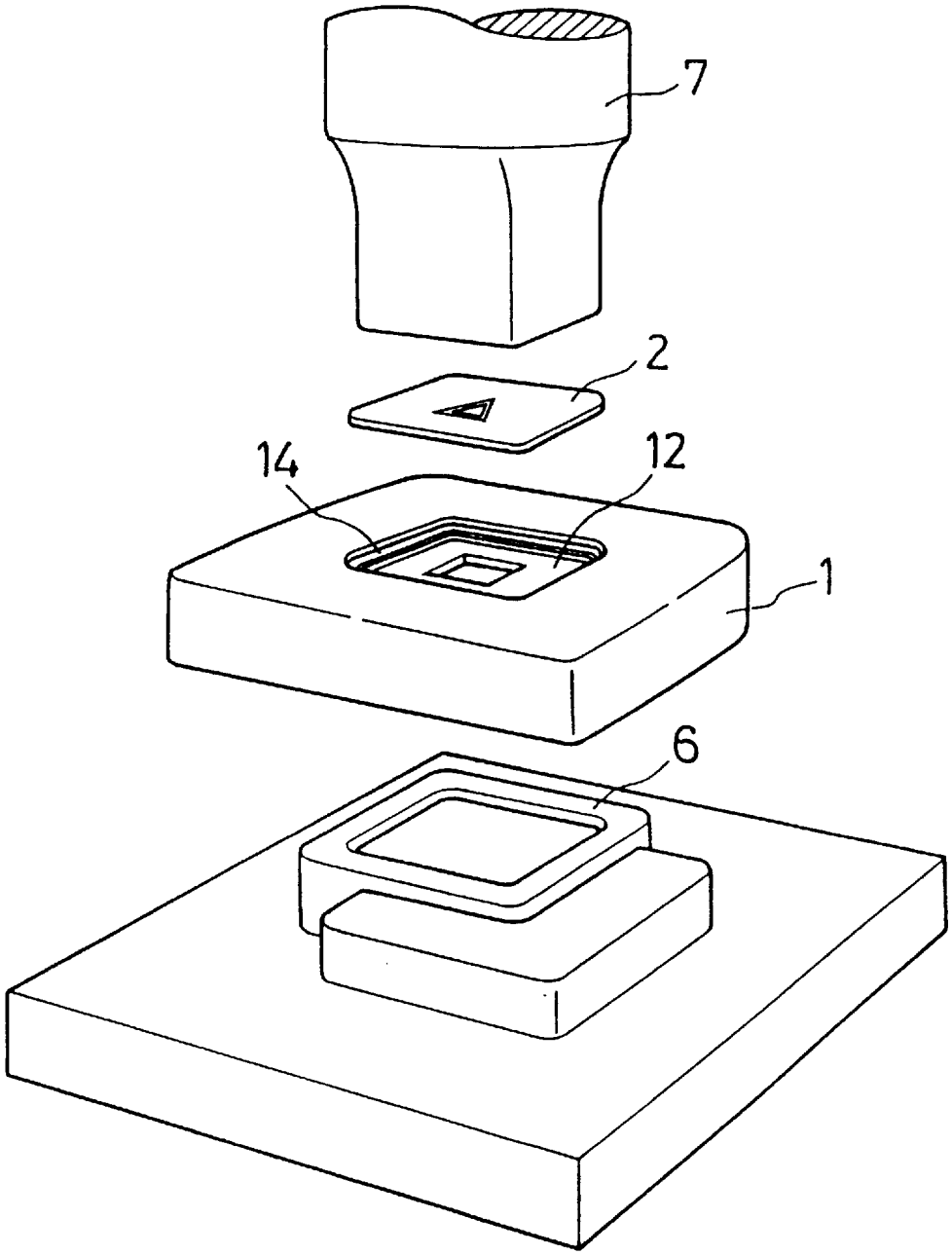
FIG. 4 is a perspective view showing the first embodiment when the name plate is welded to the knob.

When manufacturing the knob 1, the knob 1 is first molded using a resin material, such as ABS. The knob 1 is then placed on a jig 6 on a base, as shown in FIG. 4. A slab of a transparent resin material, such as polycarbonate, is cut into the name plate 2 and a desired color together with the mark or character 21 is printed on the name plate 2. The back side of the name plate 2 is applied with an opaque black pigment except for the area in which the mark or character 21 is printed. The name plate 2 is placed in the recess 12 of the knob 1 mounted on the jig 6. Then, a horn 7 is allowed to abut the name plate 2 from above, the free end of the horn 7 being aligned with the projection 14 and holding the name plate 2 therebetween. Ultrasonic waves are applied to the horn 7 so that energy is concentrated on the projection 14 to melt the projection 14 and name plate 2 together (FIG. 4).

Figure 5:
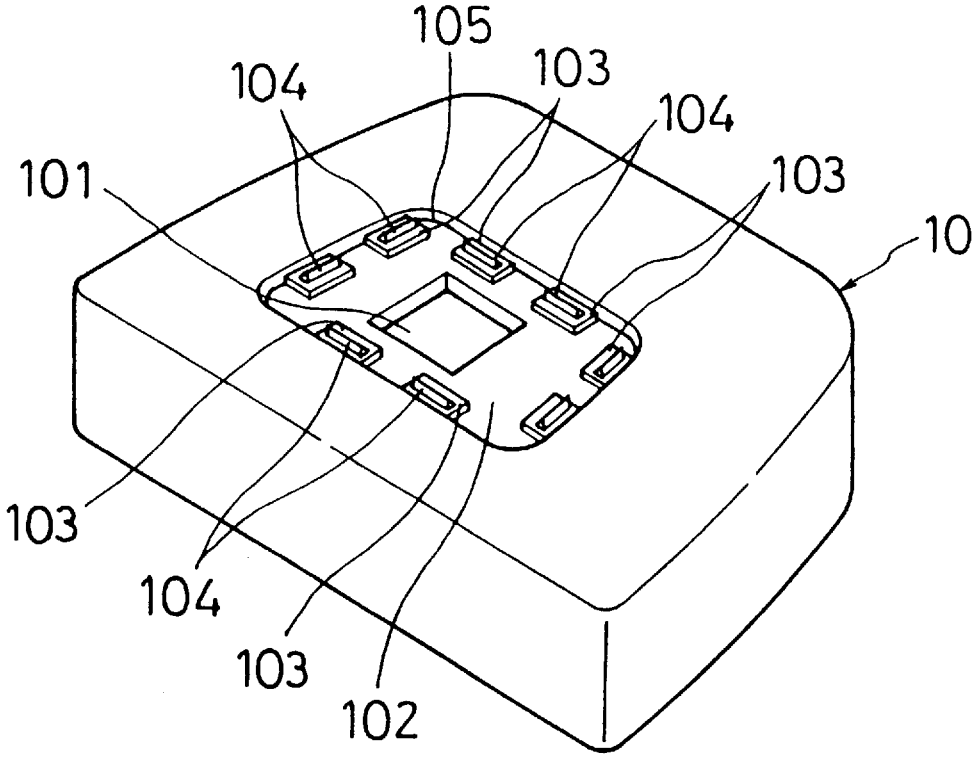
FIG. 5 is a perspective view of a knob according to a second embodiment of the present invention.

FIG. 5 illustrates a second embodiment of the present invention. The second embodiment differs from the first embodiment in the construction of the boss 13 and the projection 14.

Just as in the first embodiment, the knob 10 is formed with a recess 102 therein, which has a substantially the same trapezoidal geometry as the knob 10. A rectangular window 101 is provided in the middle of the bottom of the recess 102, and the light emitted from the light source passes through the window 101 for lighting the name plate 2. In the second embodiment, a total of eight rectangular bosses 103 are provided on the bottom of the recess 102 near the peripheral wall defining the recess 102. Two bosses 103 are provided on each of the four sides of the trapezoidal geometry of the recess 102. Each of the bosses 103 has a projection 104 formed thereon which is slightly shorter than the boss 103 and has a triangular cross section. There is also a groove 105 between the bosses 103 and the wall of the recess 102 just as in the first embodiment.

Figure 6:
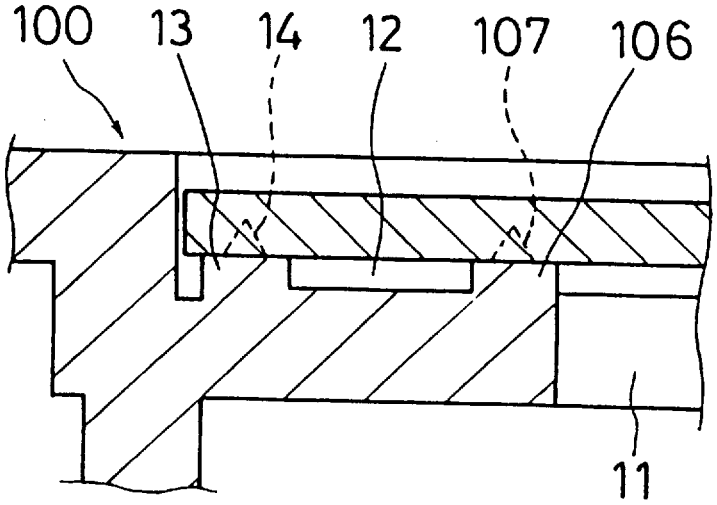
FIG. 6 is a cross-sectional view showing a relevant part of a knob according to a third embodiment of the present invention.

FIG. 6 illustrates a third embodiment of the present invention. The third embodiment is characterized in that another loop-like boss 106 is provided inside of the loop-like boss 3 of the first embodiment.

The additional loop-like boss 106 has a loop-like projection 107 which has a triangular cross section and is formed on a top surface thereof. The boss 106 and projection 107 are similar to the boss 13 and projection 14, respectively. The boss 106 surrounds and defines a window 11 formed in the bottom of the recess 12. The third embodiment further ensures that the name plate 2 is firmly welded by ultrasonic welding.

The manufacturing processes of the name plate and knob in the second and third embodiments are the same as those in the first embodiment.

The first to third embodiments have been described with respect to a combination of a loop-like boss and a loop-like projection formed on the top surface of the first projection, and a combination of separate bosses and separate projections formed on the top of the bosses. The loop-like boss or separate bosses may be omitted, and only the loop-like projection or separate projections may be formed directly on the bottom of the recess. Alternatively, the loop-like boss may be formed with separate projections formed thereon, or a loop-like projection may be formed on the separate bosses so that the loop-like projection bridges the separate bosses. In the third embodiment where a plurality of projections are formed, a loop-like projection and separate projections may be used in combination.

According to a first aspect of the present invention, use of a double-sided adhesive tape is replaced by ultrasonic welding when fixedly mounting the name plate to the knob. Ultrasonic welding is advantageous in that the adhesion will not deteriorate over time due to changes in environmental conditions, thereby preventing the name plate from coming off the knob. The adhesion will not vary depending on the surface roughness and soiling of the surface. Moreover, the ultrasonic welding technique eliminates steps where the double-sided adhesive tape is first applied to either the name plate or the knob and then one member is bonded to the other, thereby improving manufacturing efficiency. Further, when a lighted switch is used in the knob, the adhesive applied to the underside of the name plate opposing the window for lighting attracts dust and other foreign matter, which passes a less amount of light therethrough, thereby causing non-uniform lighting or dark lighting of the mark or character.

According to another aspect of the invention, the boss rises from the bottom of the recess and is formed with a projection thereon. The name plate is placed on the projection so that the other parts of the name plate are not in contact with any part of the recess. This eliminates, for example, distortions of the name plate even if the bottom of the recess occupying a relatively large area is not made so smooth and flat when manufacturing the knob.

According to another aspect of the invention, the loop-like projection is formed close to and in parallel with the wall defining the recess. This construction allows the name plate to be welded to the projection all around the periphery of the name plate, the welded portion describing a loop, and prevents light from leaking through the periphery of the name plate if a lighted switch is used.

According to another aspect of the invention, the short projections are aligned with distances therebetween and in parallel with the wall. This arrangement of projections requires only a small amount of energy when welding the name plate to the knob using ultrasonic welding, thereby eliminating the possibility of the horn damaging or scratching the surface of the name plate when the horn directly contacts the name plate.

According to yet another aspect of the invention, there is a groove between the wall of the recess and the boss or bosses. If the boss is formed integrally continuous with the wall of the recess, a curved surface may be formed which rises gradually from the top surface of the boss to the vertical surface of the wall. When the name plate is placed on the boss, the name plate may override the curved surface which raises the underside of the name plate from the flat top surface of the boss. The groove between the wall and the boss provides a space into which the melted resin material of the projection flows during welding. The groove effectively provides a path into which the melted resin spreads, thereby eliminating a chance that the melted resin material cannot find any path to flow and merely pushes up the name plate if the groove is not formed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A construction of an operating knob for a switch, comprising:

a recess (12) having a sidewall wherein said recess is formed in a surface of the operating knob;

a projection (14) having a raised surface and formed within the recess (12) such that the projection is spaced from the sidewall; and a flat plate-like name plate (2) substantially configured to the recess, wherein the name plate (2) and the projection (14) are melted together in the recess by ultrasonic welding.

2. The construction according to claim 1, further including a boss (13) which is formed and projects in the recess, wherein the projection (14) is formed on a surface of the boss (13).

3. The construction according to claim 2, wherein the projection (14) is formed in a loop shape close to the sidewall.

4. The construction according to claim 2, wherein there are provided a plurality of the projections (104) with distances therebetween, the projections (104) being close to the sidewall.

5. The construction according to claim 1, wherein the projection (14) is formed in a loop shape close to the sidewall.

6. The construction according to claim 1, wherein there are provided a plurality of the projections (104) with distances therebetween, the projections (104) being close to the sidewall.

7. A construction of an operating knob for a switch, comprising:

a recess (12) formed in a surface of the operating knob;

a projection (14) formed within the recess (12) along an outer periphery of the recess adjacent to a wall defining the recess, a groove (15) being defined between the wall and the projection (14);

a flat plate-like name plate (2) substantially configured to the recess, the name plate having a translucent portion defining a mark or character (21), the name plate (2) and the projection (14) being melted together in the recess by ultrasonic welding; and a window (11) extending through the bottom of the recess (12) for allowing light from a light source (3) to pass through the window (11) for lighting the name plate (2).

8. The construction according to claim 7, wherein said projection comprises a continuous loop-like projection that extends around the outer periphery of the recess.

9. The construction according to claim 7, wherein said projection comprises a plurality of projections (104) with distances therebetween.

10. The construction according to claim 7, wherein said projection has a generally triangular cross section before being ultrasonically welded to the name plate.

11. A construction of an operating knob for a switch, comprising:

a recess (12) formed in a surface of the operating knob;

a projection (14) formed within the recess (12);

a boss (13) which is formed and projects in the recess, wherein the projection (14) is formed on a surface of the boss (13);

a loop-like recess between a wall defining the recess and the boss (13); and a flat plate-like name plate (2) substantially configured to the recess, wherein the name plate (2) and the projection (14) are melted together in the recess by ultrasonic welding.

* * * * *